United States Patent [19]

Mendenhall

[11] Patent Number: 5,046,388

[45] Date of Patent: Sep. 10, 1991

[54] DECORATIVE FORM HYDRAULIC CUTTING BLADE ASSEMBLY

[76] Inventor: George A. Mendenhall, 4252 S. Eagleson Rd., Boise, Id. 83705

[21] Appl. No.: 498,944

[22] Filed: Mar. 26, 1990

Related U.S. Application Data

[63] Continuation-in-part of Ser. No. 460,849, Dec. 8, 1989, abandoned, which is a continuation of Ser. No. 268,676, Nov. 7, 1988, Pat. No. 4,911,045, which is a continuation of Ser. No. 59,614, Jun. 8, 1987, abandoned.

[51] Int. Cl.[5] ..... B26D 7/06; B26D 1/03

[52] U.S. Cl. ..... 83/98; 83/24; 83/402

[58] Field of Search ..... 83/24, 27, 98, 402; 30/305, 315; 426/518

[56] References Cited

U.S. PATENT DOCUMENTS

| | | | |
|---|---|---|---|
| 2,119,260 | 5/1938 | Valle | 30/316 |
| 3,109,468 | 11/1963 | Lamb et al. | 83/98 |
| 4,082,024 | 4/1978 | Hodges et al. | 83/98 |
| 4,372,184 | 2/1983 | Fisher et al. | 83/98 |
| 4,614,141 | 9/1986 | Mendenhall et al. | 83/98 |
| 4,911,045 | 3/1990 | Mendenhall | 83/24 |

*Primary Examiner*—Mark Rosenbaum
*Assistant Examiner*—Scott A. Smith
*Attorney, Agent, or Firm*—Frank J. Dykas; Craig M. Korfanta

[57] ABSTRACT

A cutter blade assembly (10) having a plurality of strip knives (15) for cutting away peripheral segments (19) of a potato (17) in order to define a decorative geometric shape for the residual cross sectional core area (18) of the potato, for use in a hydraulic food cutting apparatus and decorative food cores manufactured by the process disclosed herein.

18 Claims, 13 Drawing Sheets

DECORATIVE FORM HYDRAULIC CUTTING BLADE ASSEMBLY

RELATED APPLICATIONS

This application is a continuation-in-part of U.S. application Ser. No. 07/460,849 filed on 12/08/89, now abandoned, which is a continuation of U.S. application Ser. No. 07/268,676 filed on 11/07/88, now U.S. Pat. No. 4,911,045, which is a continuation of U.S. application Ser. No. 07/059,614 filed on 06/08/87, now abandoned.

BACKGROUND OF THE INVENTION

1. Technical Field

This invention relates to cutting blade assemblies for hydraulic food cutting apparatus. More particularly it relates to a cutter blade assembly which defines a core area and a peripheral scrap area wherein the core area of the food product is cut into a recognizable decorative form.

2. Background Art

Many food products, and particularly vegetables and fruits are processed prior to sale either by canning or freezing. Unless the product involved is of a naturally occurring edible size, for example peas, the product is usually trimmed and sliced, or diced, to edible size prior to preservation processing such as canning or freezing.

These slicing, dicing and other cutting operations have traditionally been accomplished with mechanical cutters. However, relatively recent advances in food product cutting technologies have resulted in the common use of hydraulic cutting apparatus which can be used to cut relatively huge quantities of food product at very high speeds. Cutting capacities of 13,600 kilograms to 22,700 kilograms per hour are not unusual.

In a typical hydraulic cutting apparatus wherein potatoes are to be cut, they are dropped into a tank filled with water and then pumped through conduit into an alignment chute wherein the potatoes are aligned and accelerated to high speed before impinging upon a cutter blade assembly where the potato core is cut into a plurality of smaller pieces. Hydraulic cutting apparatus, or as they are known in the trade, hydroknives, can be utilized to cut extremely high volumes of potatoes if the potatoes can be properly aligned and accelerated to high speed immediately prior to impact with the cutter blade assembly.

Fisher, et al., U.S. Pat. No. 4,372,184, discloses a cutter blade assembly for use in coring a potato.

Quite obviously there are a variety of applications for hydraulic cutter knives other than just for potatoes. Some of these would include beets, pickles, carrots, apples, pineapples and literally a host of other edible food products.

None of the prior art discloses or teaches a method of utilizing a hydroknife apparatus for cutting the core of a potato into a decorative form so as to enhance the marketing value of the processed food product, such as fish-shaped french fries for fast food seafood restaurants. Or, to enhance the edible appeal of the product in relationship to a particular market group such as alphabet french fries for small children.

Decorative shaped food products have been developed and successfully marketed for many years. However, as a universal rule, they are formed products as opposed to directly cut from food product in original cellular form. Examples include cookie and pasta dough which is then either extruded and then cross sliced or sheet cut by cookie cutter type apparatus. The direct cutting of a decorative shape of a product core, which can then be cross sliced has not been attempted before.

Accordingly, it is an object of this invention to produce a cutter blade assembly which can be utilized in a hydraulic cutting apparatus to cut the core of food product passing through the cutter blade assembly into a decorative, recognizable shape.

DISCLOSURE OF INVENTION

This object is achieved by use of a cutter blade assembly wherein a plurality of strip knives are utilized to define peripheral segments of the longitudinal passageway which result in a residual cross sectional core area having a particular decorative shape.

Because of the dynamic forces associated with the impact of the product against the strip knives, and the need to frequently sharpen the strip knives, it is not practical to fabricate the complete form from a single strip knife in cookie cutter fashion. Instead, the perimeter frame is subdivided into a number of parallel sequential planes, each containing strip knives which define particular segments of the peripheral area.

End tabs on the strip knives are inserted into notches in the perimeter frame and are held firmly in position to minimize wobble by compression of said tabs inserted into the perimeter frame from the strip knives when the various sections of the perimeter frame are bolted together.

BEST MODE FOR CARRYING OUT INVENTION

Figure 1:
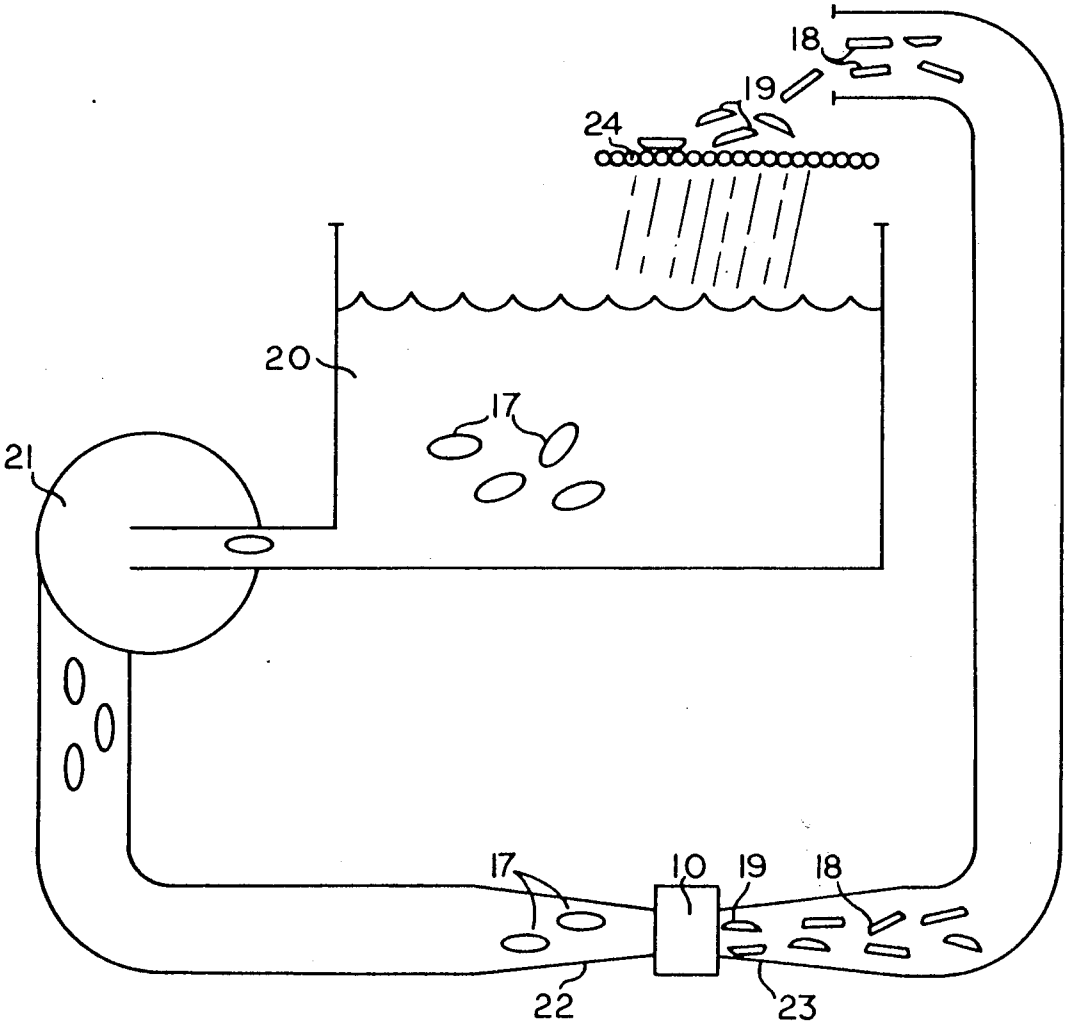
FIG. 1 is a schematic representation of a hydraulic cutting apparatus.

FIG. 1 shows, in schematical format, the main components of a hydraulic cutting apparatus for use in cutting potatoes. Potatoes 17 are dumped into the water filled receiving tank 20. Food pump 21, usually a single impeller centrifugal pump, draws its suction from receiving tank 20, and pumps water and the suspended potatoes 17 from the tank into nozzle gun 22.

Nozzle gun 22 functions as a venturi which is used to accelerate and align potatoes 17 immediately prior to impinging upon the knife blades of cutter blade assembly 10. Depending upon the product being cut, its size, core density and physical characteristics, normal speeds at the point of impingement upon the knife blades of cutter blade assembly 10 range from 12.2 meters per second to 18.3 meters per second.

The cut product, which in this case is a decoratively shaped potato core 18, and the peripheral scrap 19 exit cutter blade assembly 10 into deceleration loop 23 which in effect is the second half of the venturi. The deceleration loop returns to a point above receiving tank 20 where the water, cut cores 18 and scrap 19 are deposited onto chain separator 24. The water passes through chain separator 24 and returns to receiving tank 20. Chain separator 24 is typically an endless loop chain or dewatering shaker which is used to mechanically remove the potatoes from the hydraulic cutting apparatus assembly. The decorative cores 18 and scrap 19 are then usually mechanically separated by means of a sizer conveyor, not shown. The cores 18 are then sliced, again usually mechanically, into appropriate thicknesses for further processing by blanching, freezing and packaging for sale.

The cutter blade assemblies in use today normally run at capacities of 13,600 kilograms per hour to 22,700 kilograms per hour, and can be operated at capacities of up to 45,360 kilograms of product per hour. During the course of an eight hour work shift, that represents a relatively huge amount of food product passing through the cutter blade assembly, and as a result, strip knives are removed for resharpening about once per eight hour work shift.

Figure 3:
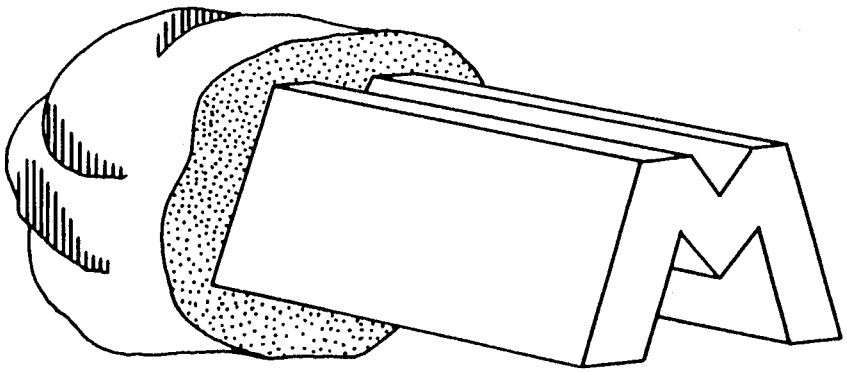
FIG. 3 is a representational perspective view of a partially cut potato core in the shape of an M.
Figure 2:
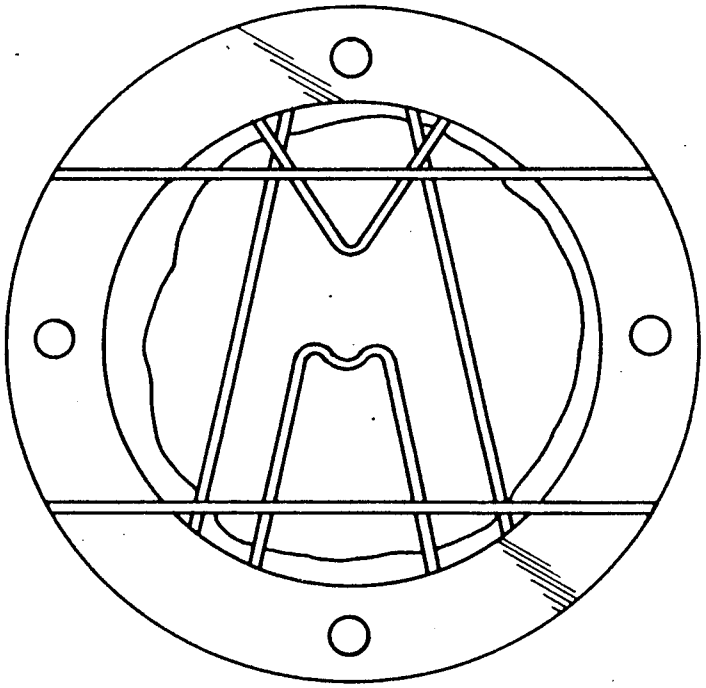
FIG. 2 is a plan view of a cutter blade assembly for cutting a decorative M.
Figure 4:
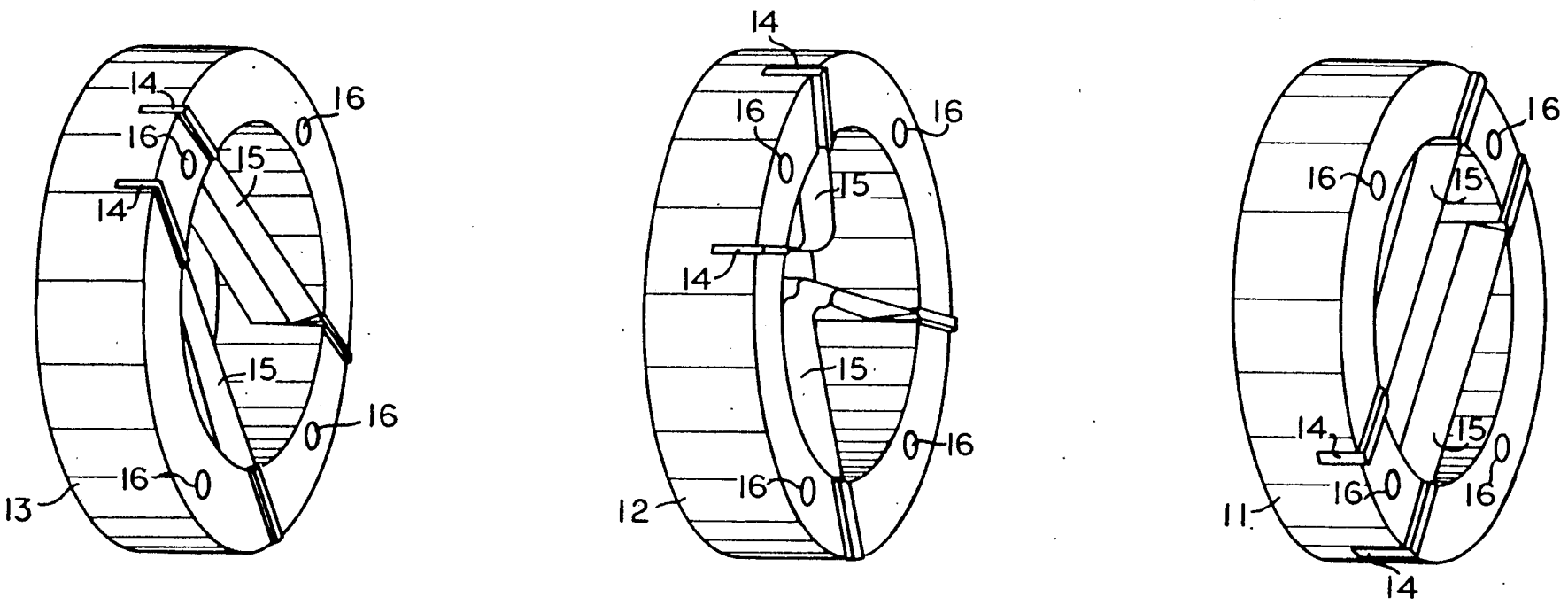
FIG. 4 is an exploded representational perspective view of the cutter blade assembly for cutting a decorative core M.
Figure 5:
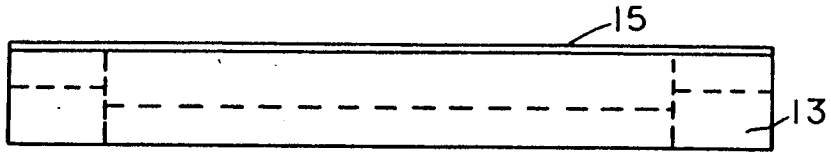
FIG. 5 is a representational side view of a cutter blade ring and blade.

Referring to FIGS. 2, 4 and 5, my cutter blade assembly, in an embodiment designed to produce a potato core in the shape of an M, as shown in FIG. 3, is disclosed. In order to produce the decorative M, as is shown in FIGS. 2 and 3, a plurality of strip knives must be utilized to cut away peripheral segments of the potato in order to define an M in the core area of the potato. The end tabs of strip knives 15 as is shown in FIGS. 4 and 5 are inserted into notches 14 of rings 11, 12 and 13, and together, define a multisegmented peripheral volume of the longitudinal passageway. By arranging a plurality of strip knives 15 to define various segments of the longitudinal passageway, the residual cross sectional core area can be shaped into a variety of recognizable decorative forms. In the case of a decorative M as shown in FIGS. 2, 3, and 4, six strip knives are required, and result in a core in the form of a decorative M and up to twelve separate peripheral areas. Referring to FIG. 2, whole potato 17 is schematically represented at the point where it is just about to impinge upon the cutter blade assembly 10. It can be seen that potato 17 will be cut into a potato core having a cross sectional shape of an M and twelve separate peripheral scraps.

FIG. 5 is a representational side view which shows a feature of my invention which results in a minimization of wobble of the strip knives in the cutter blade assembly. The end tab sections of strip knife 15 are slightly elevated above the plane surface of ring 13 so that when all of the rings containing the strip knives are bolted together by use of bolts passing through holes 16, strip knives 15 will be tightly clamped into place.

This design, as is shown in FIGS. 4 and 5 results in a cutter blade assembly which can be quickly disassembled for purposes of removing and sharpening strip knives 15.

Figure 6:
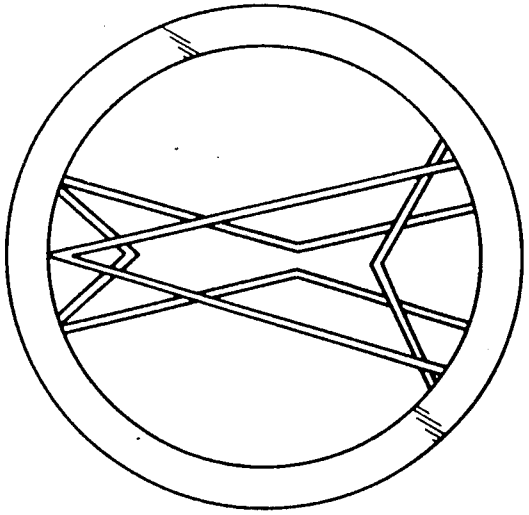
FIG. 6 is a representational view of the cutter blade assembly for cutting a single decorative fish shaped core.
Figure 8:
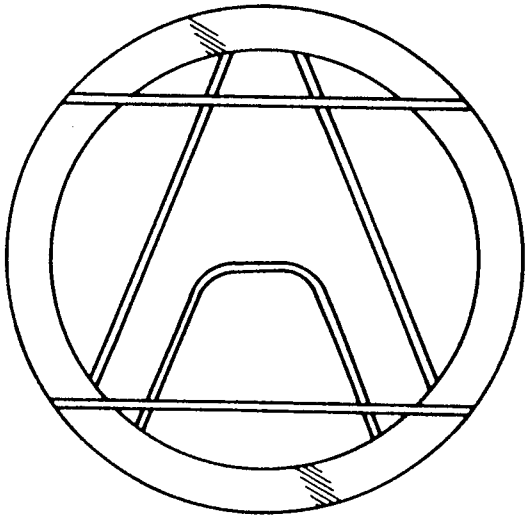
FIG. 8 is a representational view of the cutter blade assembly for cutting a decorative A shaped core.
Figure 7:
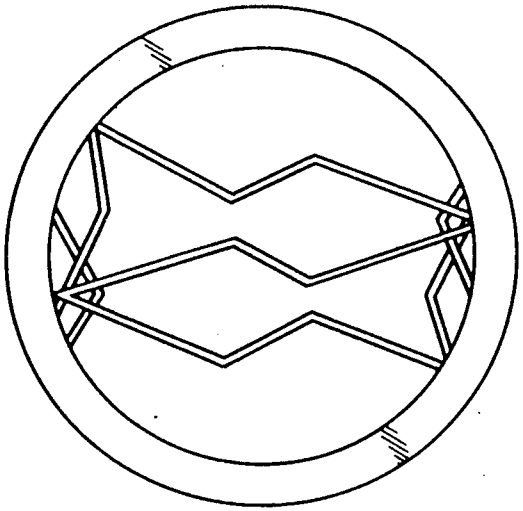
FIG. 7 is a representational view of the cutter blade assembly for cutting two decorative fish shaped cores.
Figure 10:
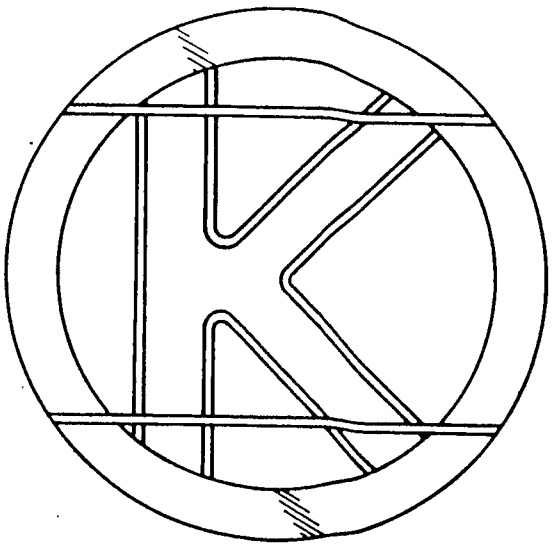
FIG. 10 is a representational view of the cutter blade assembly for cutting a decorative K shaped core.
Figure 9:
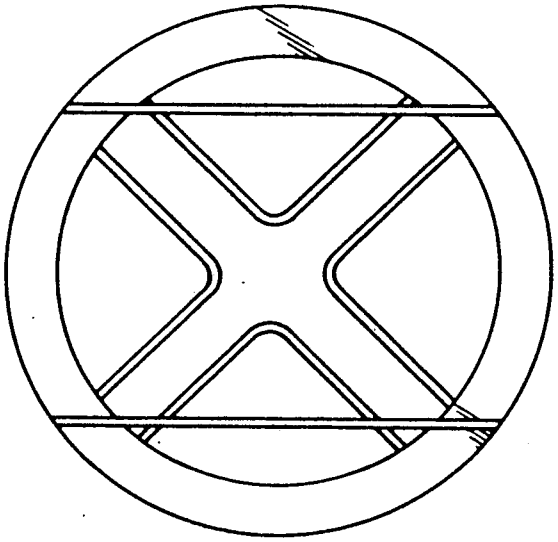
FIG. 9 is a representational view of the cutter blade assembly for cutting an decorative X shaped core.
Figure 11:
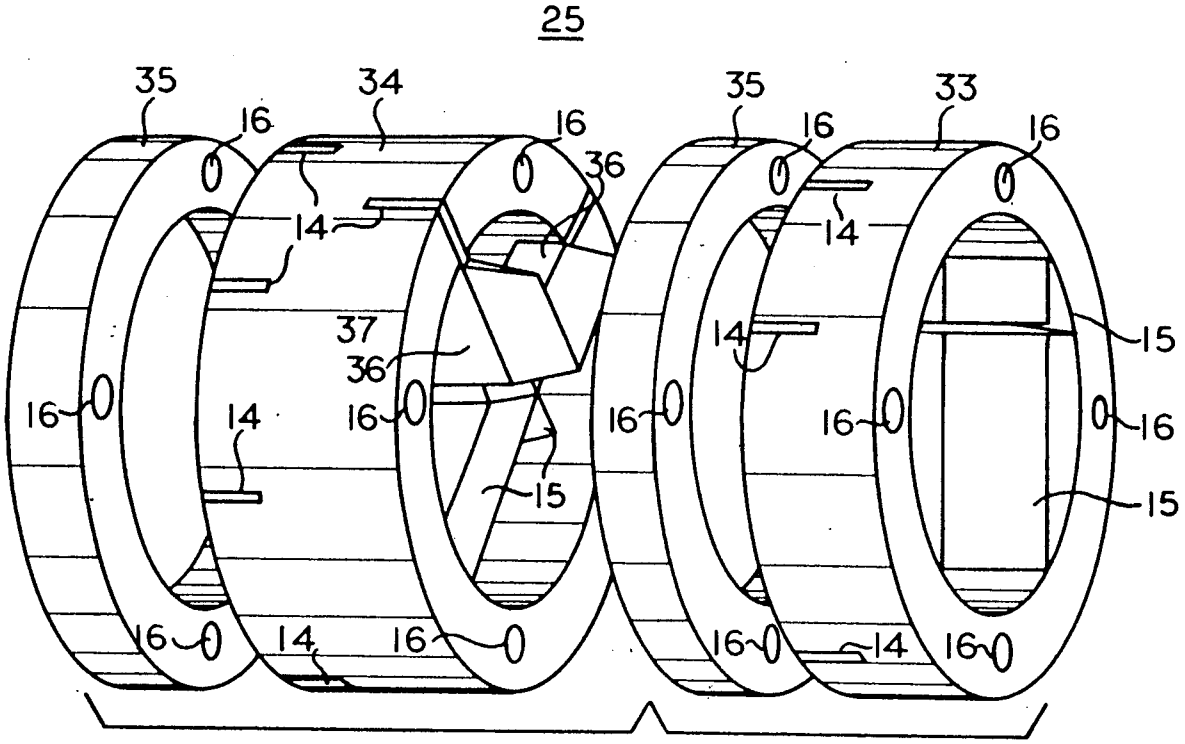
FIG. 11 is an exploded representational perspective view of a cutter blade assembly for cutting a decorative core in the shape of a playing card heart.
Figure 13:
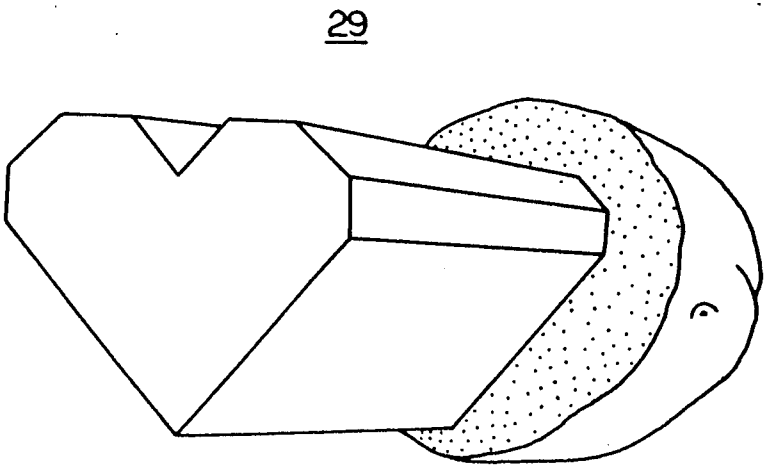
FIG. 13 is a representational perspective view of a partially cut potato core in the shape of a playing card heart.
Figure 12:
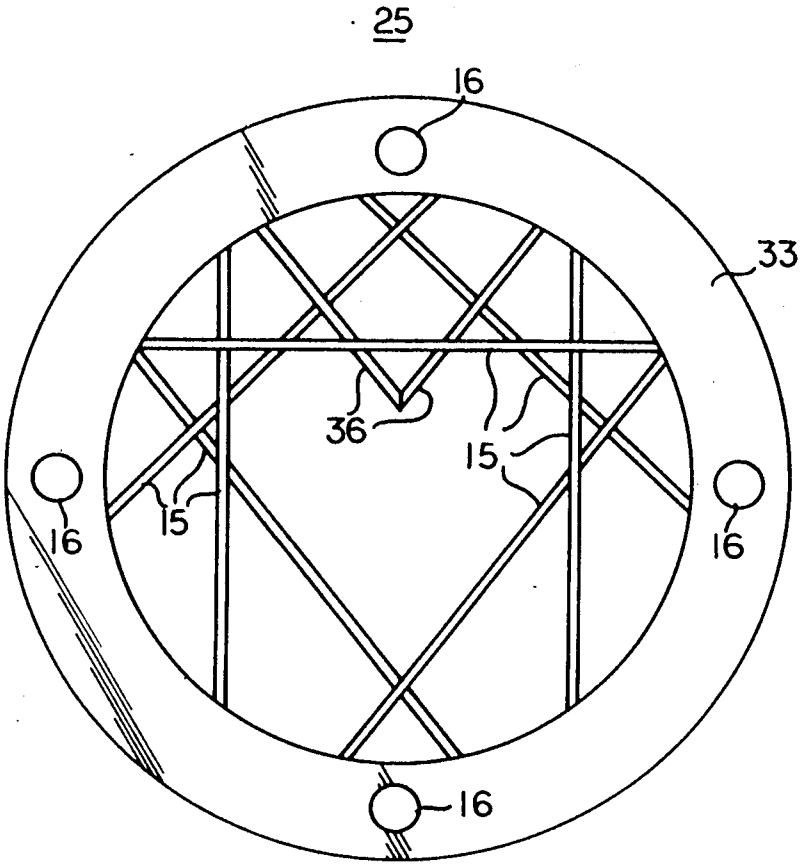
FIG. 12 is a front end view of the cutter blade assembly for cutting a decorative playing card heart.
Figure 14:
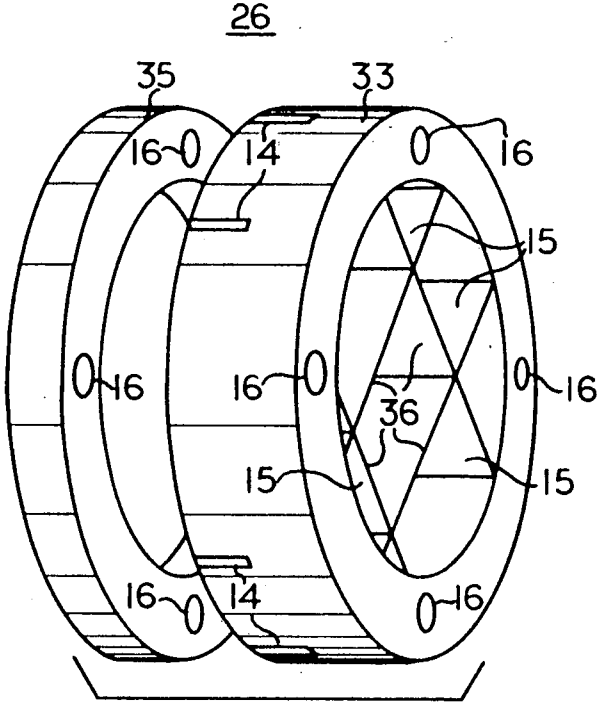
FIG. 14 is an exploded representational perspective view of a cutter blade assembly for cutting a decorative core in the shape of a playing card diamond.
Figure 16:
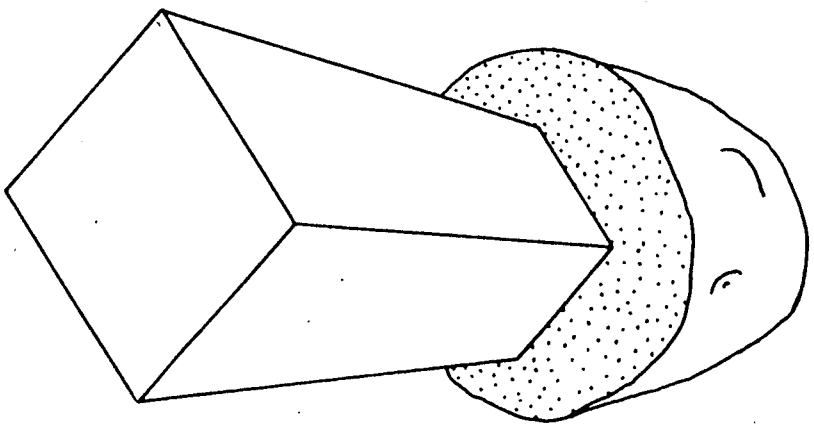
FIG. 16 is a representational perspective view of a partially cut potato core in the shape of a playing card diamond.
Figure 15:
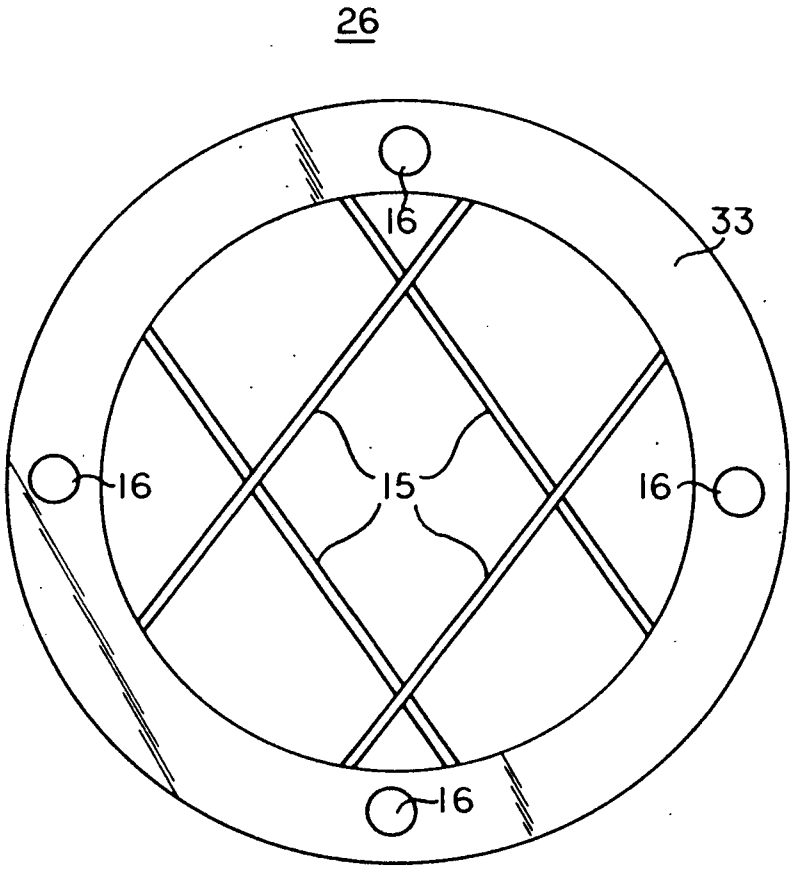
FIG. 15 is a front end view of the cutter blade assembly for cutting a decorative playing card diamond.
Figure 17:
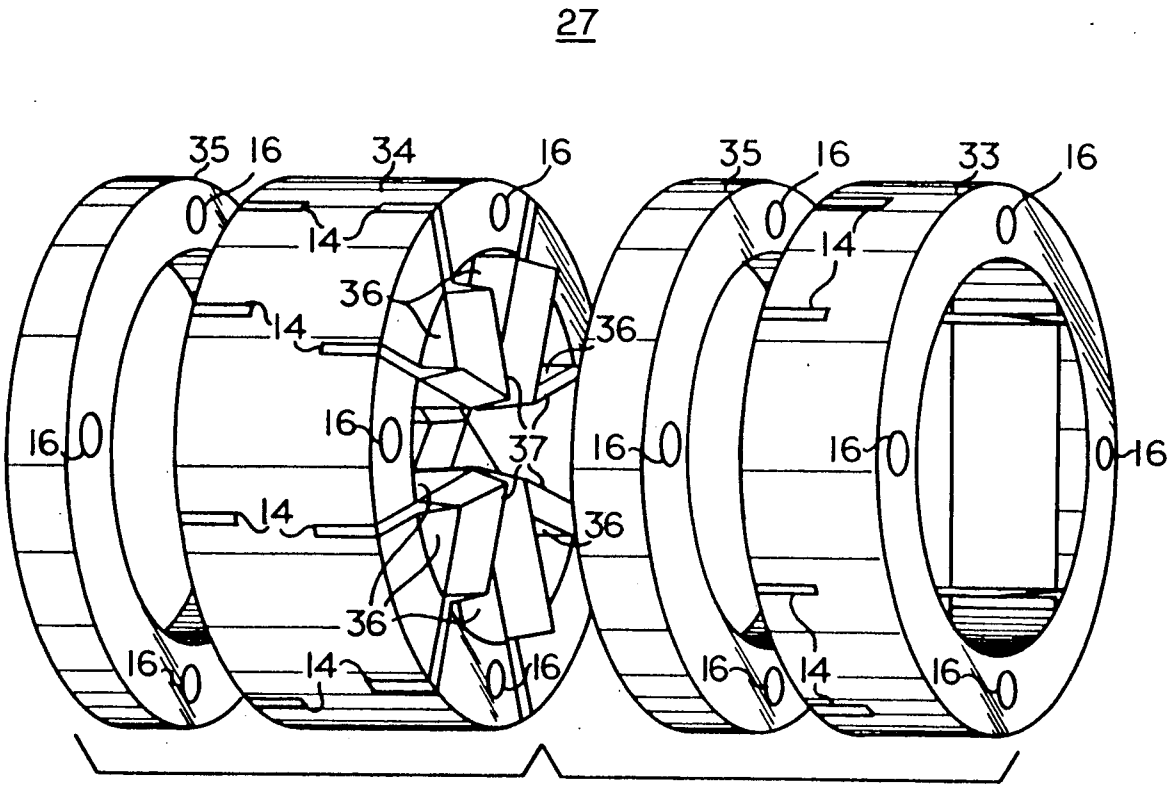
FIG. 17 is an exploded representational perspective view of a cutter blade assembly for cutting a decorative core in the shape of a playing card club.
Figure 19:
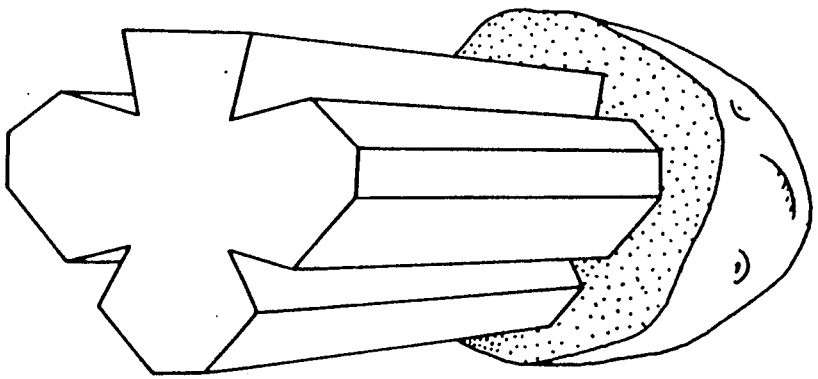
FIG. 19 is a representational perspective view of a partially cut potato core in the shape of a playing card club.
Figure 18:
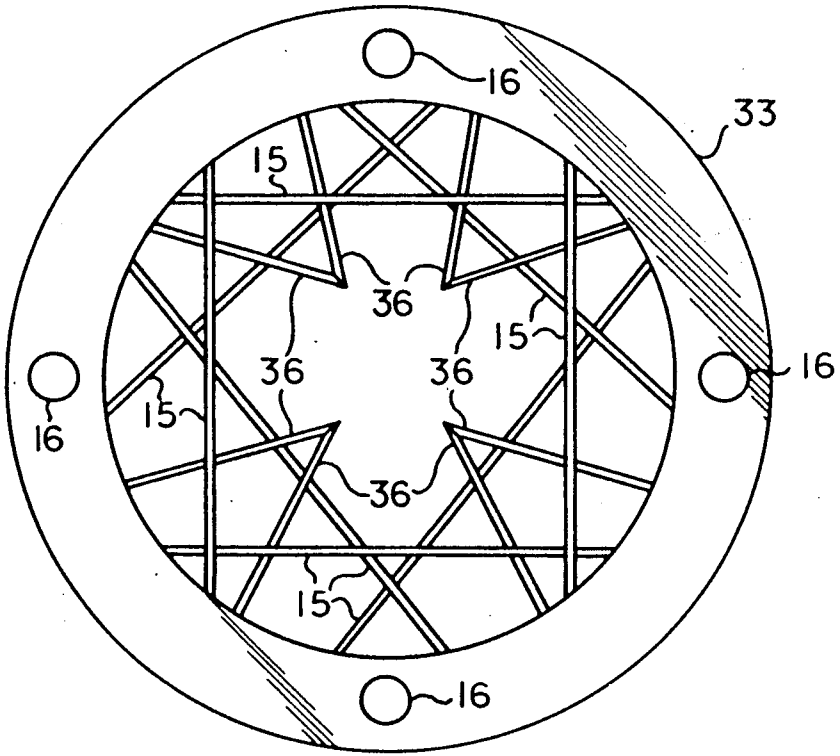
FIG. 18 is a front end view of the cutter blade assembly for cutting a decorative playing card club.
Figure 20:
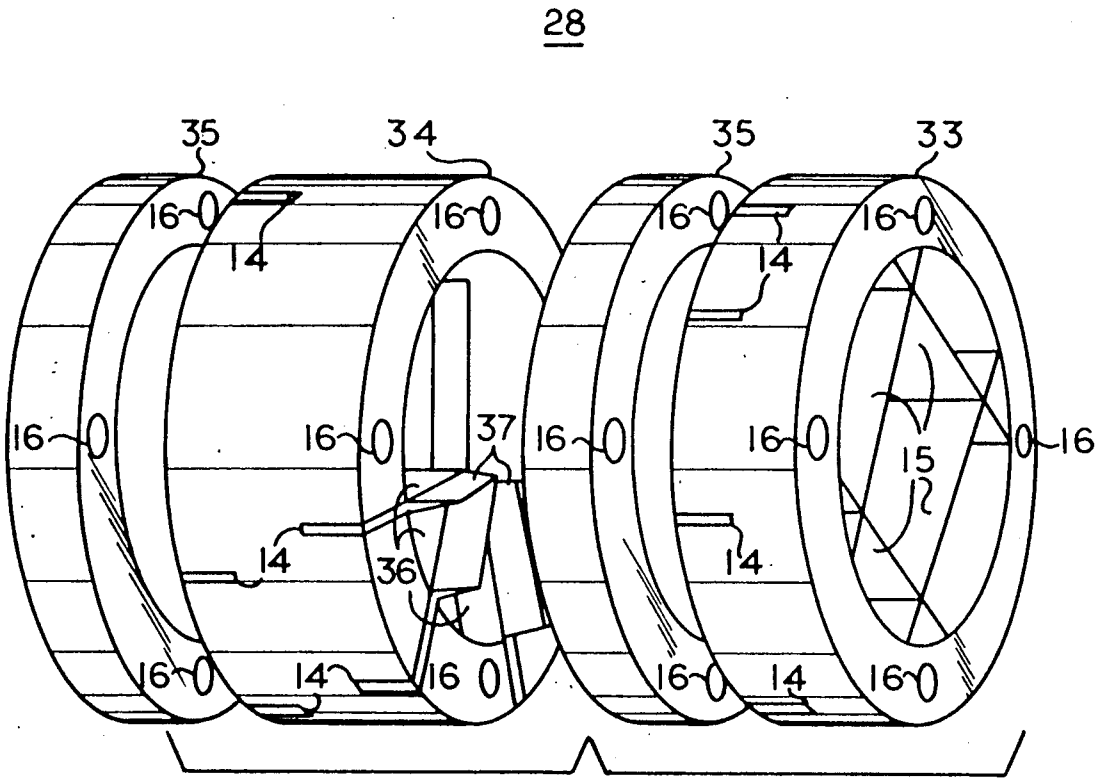
FIG. 20 is an exploded representational perspective view of a cutter blade assembly for cutting a decorative core in the shape of a playing card spade.
Figure 22:
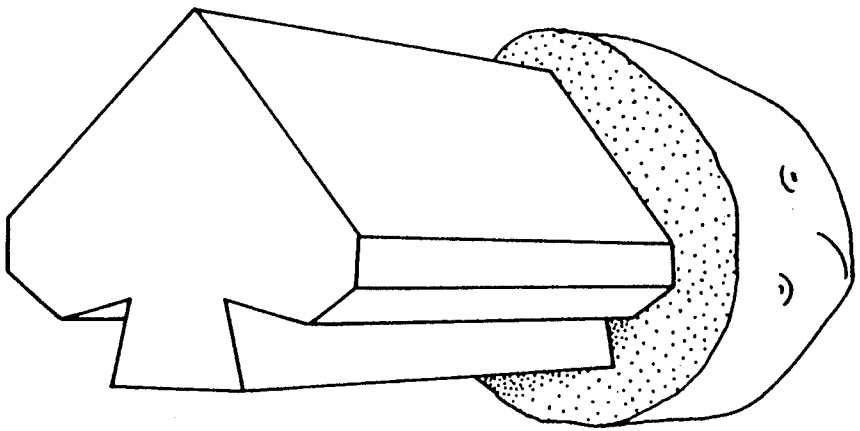
FIG. 22 is a representational perspective view of a partially cut potato core in the shape of a playing card spade.
Figure 21:
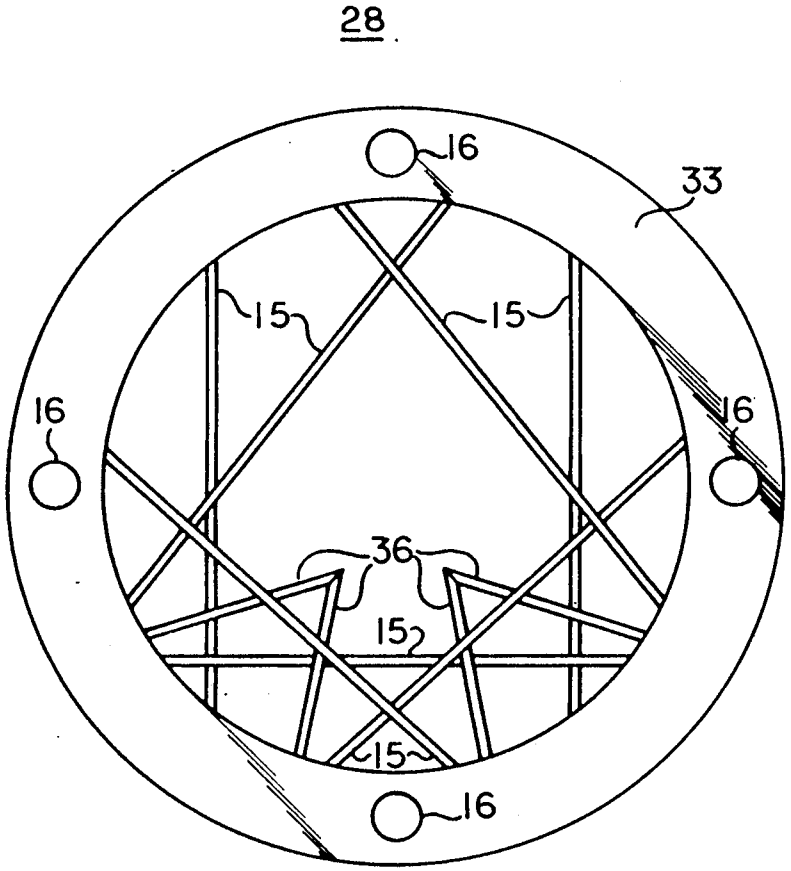
FIG. 21 is a front end view of the cutter blade assembly for cutting a decorative playing card spade.

FIGS. 6 through 10 show other configurations of the strip knives which are designed to produce decorative shaped cores in a variety of different configurations. FIGS. 6 and 7 disclose strip knife configurations which result in a decorative core in the shape of fish. FIG. 6 uses six strip knives to configure the core in the shape of a single fish. It requires the use of three sectional rings to hold six strip knives. FIG. 7 discloses a strip knife configuration which results in the product core being cut into two decorative fish sections, and requires the use of eight strip knives and four ring sections. FIGS. 8, 9 and 10 disclose other configurations of strip knives which result in core shapes in the forms of an A, X and K. In practice it has been found that virtually all of the letters of the alphabet as well as decorative geometric shapes such as stars and triangles can be easily produced by varying the configurations of the strip knives.

Referring now to FIGS. 13 through 22, four separate cutters, 25, 26, 27 and 28, are shown for cutting decorative food cores in the shapes of playing card symbols, namely the heart, diamond, club and spade shapes, shown at 29, 30, 31 and 32. The resulting decorative cores 29, 30, 31 and 32 are shown in FIGS. 13, 16, 19 and 20, respectively. These four cutters are similar to the previously explained cutters, however these cutters use pairs of partial strip knives 36 instead of contoured or bent strip knives such as those shown in FIGS. 2, 4, 6, 7, 8, 9 and 10. Using pairs of partial strip knives to cut the acute angles associated with the various geometries allows the strip knives to be manufactured from stainless steel, which is more desirable but difficult to form or bend in the necessary shapes. It should be noted that the cutters illustrated in FIGS. 1 through 10 could be manufactured using partial strip knives in leu of or in addition to the bent or contoured strip knives and the cutters illustrated in FIGS. 11 through 21 could be manufactured using bent strip knives in leu of or addition to partial strip knives 36.

Cutters 25, 27 and 28 use a first notched blade ring 33, second notched blade ring 34 and spacer and retainer rings 35 to hold strip knives 15 and partial strip knives 36 in place within and to form their respective perimeter frames. Partial strip knives 36 are secured at a first end to the perimeter frame, rings 33 and 34, in notches 14. Strips knives 15 and partial strip knives 36 are provided with extending leading edges 37 such that when they are positioned one after another within the perimeter frame, they provide a continuous cutting array for any food stuff passed therethrough. This feature inhibits wobbling of the food stuff and helps insure that the final product is free from defects.

While there is shown and described the present preferred embodiment of the invention, it is to be distinctly understood that this invention is not limited thereto but may be variously embodied to practice within the scope of the following claims.

I claim:

1. In a system for the cutting of food products, having a product receiving tank adapted to be filled with a fluid medium, means to discharge said products into said tank, a food pump for withdrawing said medium and said products from said tank, a product feed line, said pump discharging said products into said product feed line, a tapered section in said feed line to separate, align, accelerate and feed said products into a cutter blade assembly, and means posterior to said cutter blade assembly, to discharge cut product, comprising a cutter blade assembly having:

a perimeter frame having an inner longitudinal passage of size and shape for the longitudinal passage of product and fluid medium there through;

a plurality of sequentially arranged strip knives disposed one after another within the longitudinal passageway of said perimeter frame and further disposed and configured to define a multisegmented peripheral volume of said longitudinal passage way and a residual cross sectional core area in the shape of a non-triangular, non-rectilinear, non-circular decorative food product;

said plurality of knives including strip knives being of size and shape so as to define said multisegented peripheral volume of the longitudinal passageway which results in the cross sectional shape of the core having a non-triangular, non-rectilinear, non-circular decorative perimeter geometry and shape.

2. The apparatus of claim 2 wherein said plurality of strip knives define a multisegmented peripheral volume of the longitudinal passageway resulting in the core cut area defining the shape of a fish.

3. The apparatus of claim 1 wherein said plurality of strip knives define a multisegmented peripheral volume of the longitudinal passageway resulting in the core cut area defining the shape of an alphanumeric character.

4. The apparatus of claim 1 further comprising:

a plurality of partial strip knives being secured at a first end to said perimeter frame and extending radially inward therefrom; and said plurality of strip knives and partial strip knives being arranged to define a multisegmented peripheral volume of the longitudinal passageway resulting in the core cut area defining the shape of a playing card heart.

5. The apparatus of claim 1 wherein said plurality of strip knives define a multisegmented peripheral volume of the longitudinal passageway resulting in the core cut area defining the shape of a playing card diamond.

6. The apparatus of claim 1 further comprising:

a plurality of partial strip knives being secured at a first end to said perimeter frame and extending radially inward therefrom; and said plurality of strip knives and partial strip knives being arranged to define a multisegmented peripheral volume of the longitudinal passageway resulting in the core cut area defining the shape of a playing card club.

7. The apparatus of claim 1 further comprising:

a plurality of partial strip knives being secured at a first end to said perimeter frame and extending radially inward therefrom; and said plurality of strip knives and partial strip knives being arranged to define a multisegmented peripheral volume of the longitudinal passageway resulting in the core cut area defining the shape of a playing card spade.

8. The apparatus of claim 1 wherein said plurality of strip knives define a multisegmented peripheral volume of the longitudinal passageway resulting in the core cut area defining the shape of an animal.

9. The apparatus of claim 1 wherein said plurality of strip knives define a multisegmented peripheral volume of the longitudinal passageway resulting in the core cut area defining the shape of a recognizable geometric form.

10. The cutter blade assembly of claim 1 wherein said plurality of strip knives are further arranged and shaped to limit the length and number of blades contacting any one segment of the food product at any given time during the passage of the food product through the longitudinal passageway whereby the frictional and shear forces imparted to the food product being cut and the resulting deceleration of food product are minimized at any given time in relation to the total frictional shear force necessary to produce the decorative food product; and at least some of said strip knives being disposed one after the other, in close spaced relationship thereto, thereby providing, along the longitudinal passageway, a continuous cutting array to any food stuff passed therethrough to prevent wobbling of the food stuff and promote production of final product which is free from defects.

11. The apparatus of claim 10 wherein said plurality of strip knives define segments of the longitudinal passageway resulting in the core cut area defining the shape of a fish.

12. The apparatus of claim 10 wherein said plurality of strip knives define segments of the longitudinal passageway resulting in the core cut area defining the shape of an alphanumeric character.

13. The apparatus of claim 10 further comprising:

a plurality of partial strip knives being secured at a first end to said perimeter frame and extending radially inward therefrom; and said plurality of strip knives and partial strip knives being arranged to define segments of the longitudinal passageway resulting in the core cut area defining the shape of a playing card heart.

14. The apparatus of claim 10 wherein said plurality of strip knives define segments of the longitudinal passageway resulting in the core cut area defining the shape of a playing card diamond.

15. The apparatus of claim 10 further comprising:

a plurality of partial strip knives being secured at a first end to said perimeter frame and extending radially inward therefrom; and said plurality of strip knives and partial strip knives being arranged to define segments of the longitudinal passageway resulting in the core cut area defining the shape of a playing card club.

16. The apparatus of claim 10 further comprising:

a plurality of partial strip knives being secured at a first end to said perimeter frame and extending radially inward therefrom; and said plurality of strip knives and partial strip knives being arranged to define segments of the longitudinal passageway resulting in the core cut area defining the shape of a playing card spade.

17. The apparatus of claim 10 wherein said plurality of strip knives define segments of the longitudinal passageway resulting in the core cut area defining the shape of an animal.

18. The apparatus of claim 10 wherein said plurality of strip knives define segments of the longitudinal passageway resulting in the core cut area defining the shape of a recognizable geometric form.

* * * * *